United States Patent [19]

Bolleter et al.

[11] 4,076,048

[45] Feb. 28, 1978

[54] SLEY DRIVE FOR A WEAVING MACHINE

[75] Inventors: Ulrich Bolleter, Seuzach; Marcel Brügger, Winterthur, both of Switzerland

[73] Assignee: Sulzer Brothers Limited, Winterthur, Switzerland

[21] Appl. No.: 692,278

[22] Filed: Jun. 3, 1976

[30] Foreign Application Priority Data

Jun. 10, 1975 Switzerland ..... 7450/75

[51] Int. Cl.[2] ..... D03D 49/60

[52] U.S. Cl. ..... 139/190

[58] Field of Search ..... 139/188–191, 139/449

[56] References Cited

U.S. PATENT DOCUMENTS

| | | | |
|---|---|---|---|
| 2,766,778 | 10/1956 | Kronoff | 139/191 |
| 3,384,130 | 5/1968 | Golobart | 139/190 |
| 3,882,902 | 5/1975 | Freisler et al. | 139/190 |
| 3,955,603 | 5/1976 | Martelli | 139/190 X |

FOREIGN PATENT DOCUMENTS

| | | | |
|---|---|---|---|
| 942,380 | 5/1956 | Germany | 139/190 |

*Primary Examiner*—James Kee Chi

*Attorney, Agent, or Firm*—Kenyon & Kenyon, Reilly, Carr & Chapin

[57] ABSTRACT

The sley drive uses a sley shaft which is separated into shaft portions which are oscillated within bearings and a balance weight in the form of a shaft section offset from and located between each pair of sley shaft portions. The balance weight is coupled at each end to a sley shaft portion and, intermediately, to the reed via sley levers and a sley so that the center of gravity of the unit composed of the parts moved by the sley shaft is located in coincidence with the axis about which the sley shaft oscillates.

15 Claims, 7 Drawing Figures

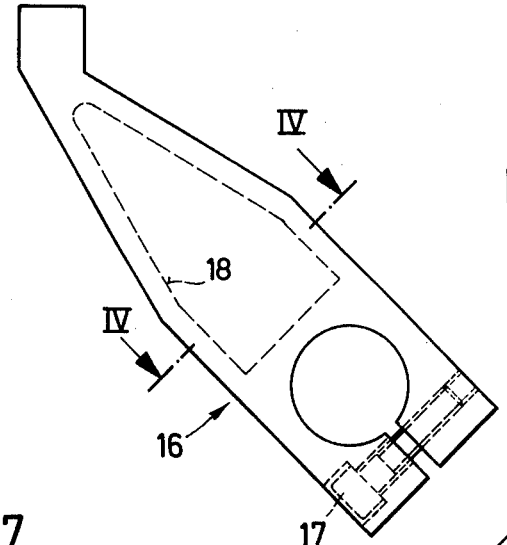
Fig. 3
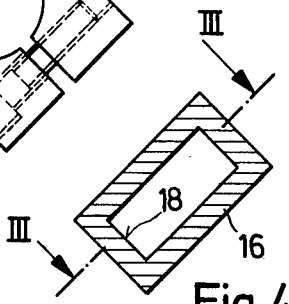
Fig. 4
Fig. 7
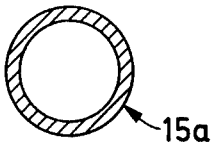
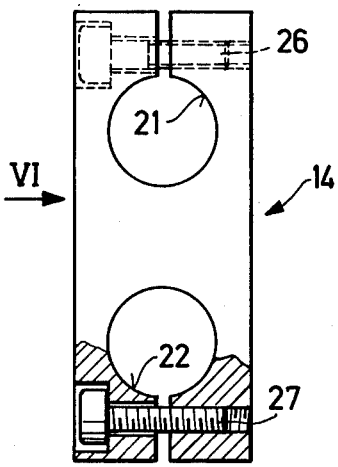
Fig. 5
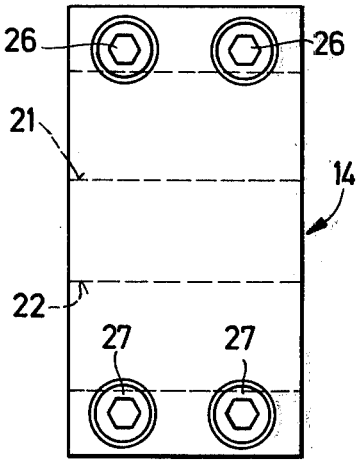
Fig. 6

SLEY DRIVE FOR A WEAVING MACHINE

This invention relates to a sley drive for a weaving machine.

As is known, sley drives for weaving machines have employed oscillating sley shafts in order to impart pivoting, i.e. oscillating motion to a reed for beat-up purposes. In one known sley drive, the center of gravity of the unit formed by the parts pivoted by the sley shaft (e.g. sley levers, sley, reed, shuttle guide, driving cam follower) is relatively far away from the sley shaft axis, for instance, by an amount corresponding to half the distance between the top end of the reed and the sley shaft axis. In operation, therefore, inertia forces arise which are transmitted through the sley-shaft bearings (sley boxes) and the driving cams for the cam follower levers of the sley shaft to the whole machine. As a result, the machine experiences additional vibrations which are manifested, inter alia, as sound vibrations (noise).

Accordingly, it is an object of the invention to provide a sley drive which is able to reduce the transmission of vibration to a weaving machine.

It is another object of the invention to provide a sley drive which can operate with a minimum of vibration.

It is another object of the invention to reduce the noise of an operating weaving machine.

Briefly, the invention provides a sley drive for a weaving machine comprising a sley shaft mounted for oscillation about a longitudinal axis, a reed and means coupling the reed to the sley shaft for oscillation about the axis of the sley shaft wherein the coupling means includes a balance weight opposite the reed relative to the axis of oscillation so that the center of gravity of the reed and coupling means is coincident with the axis of oscillation.

A particular achievement of the sley drive is that, as calculations and tests show, there is a reduction in the components of force arising from the sley shaft and transmitted to the whole machine and in the associated vibrations. More particularly, the horizontal force components which arise in the conventional construction can, to a large extent, be converted into vertical force components which, as a rule, can more readily be taken up by the whole machine frame, particularly by a central support, than can horizontal components since the central support of a weaving machine usually has a cross-section extending principally vertically, i.e. the vertical extent of the support is greater than the width. The sley drive is thus able to reduce the vibrations and noise of the machine.

According to a feature of the invention, the balance weight is embodied by at least one shaft section which extends parallel to the sley shaft and which is disposed between two sley-shaft bearings. Conveniently, the shaft section is connected by a means such as crank-web-like coupling members to the sley shaft while the reed is secured via a sley and sley levers to the shaft section.

In one embodiment, the sley shaft is interrupted near the shaft section. Consequently, despite the weight balancing, the sum of the weights of the parts secured to and pivotally reciprocated by the sley shaft viz. the sley levers, sley, reed and, where applicable, cam follower levers and a shuttle guide, is substantially the same as in the known sley drive construction having a continuous sley shaft and no weight balancing.

According to a feature of the invention, the sley levers and/or the offset shaft section are hollow members. This feature helps to keep the moment of inertia of the unit formed by the above-mentioned parts down to substantially the same level as for the known sley drive.

Thus, the drive power required for the balance construction according to the invention is substantially the same as for the prior art construction.

These and other objects and advantages of the invention will become more apparent from the following detailed description and appended claims taken in conjunction with the accompanying drawings in which:

FIG. 1 diagrammatically illustrates a front elevational view of a sley drive according to the invention of a gripper shuttle weaving machine;

FIG. 3 illustrates a detail of a sley lever in accordance with the invention;

FIG. 4 illustrates a view taken on line IV—IV of FIG. 3;

FIG. 5 illustrates a detail of a coupling member in accordance with the invention;

FIG. 6 illustrates a view in the direction of the arrow VI of FIG. 5; and FIG. 7 illustrates a cross-sectional view of a modified shaft section according to the invention.

Figure 1:
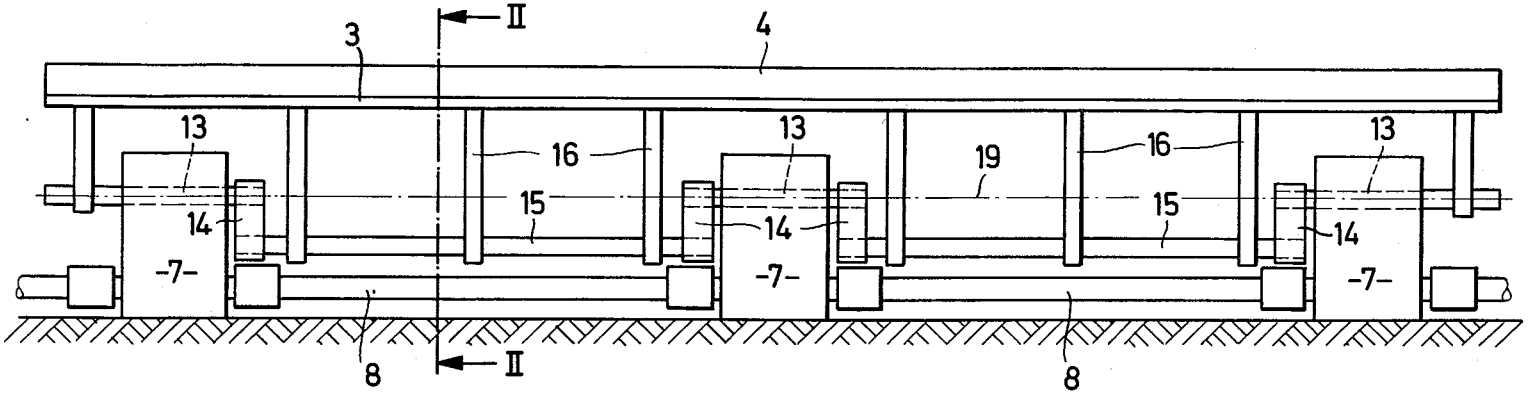

Referring to FIG. 1, a weaving machine of the gripper shuttle type includes a reed 4 for beating-up weft yarns as is known. During operation of the weaving machine, the reed 4 is reciprocated back and forth in an oscillating manner. To this end, the reed 4 is mounted on a sley 3 and oscillated by a sley drive which, in turn, is driven off a main shaft 8 of the weaving machine. As shown, the main shaft 8 passes through and is mounted in a series (three) of sley boxes or bearings 7.

Figure 2:
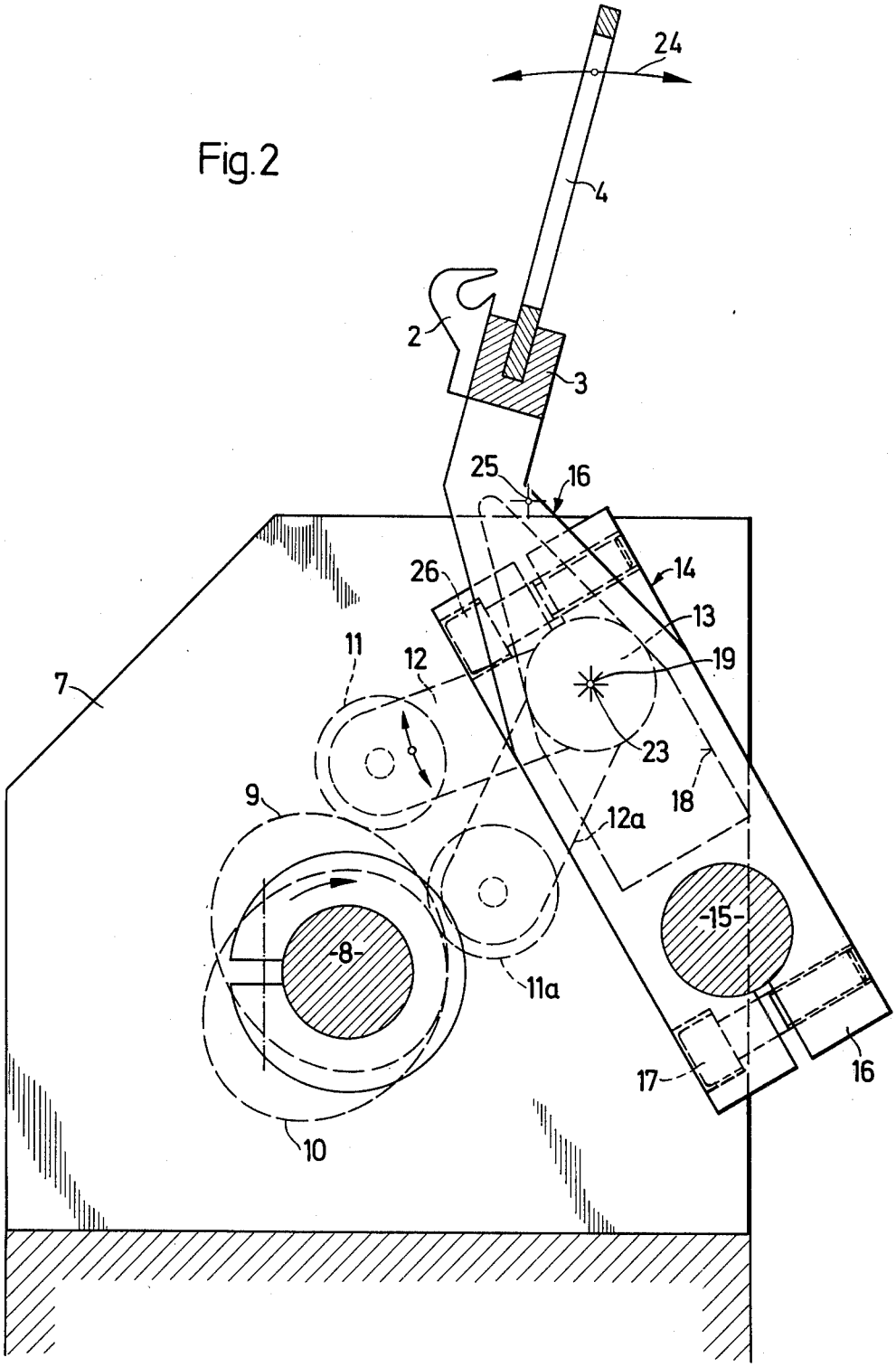
FIG. 2 illustrates a view taken on line II—II of FIG. 1.

Referring to FIGS. 1 and 2, the sley drive includes a sley shaft which is interrupted so as to have a plurality of sley shaft portions 13 located coaxially about a longitudinal axis 19. Each portion 13 is mounted for oscillation in a respective bearing 7 about the axis 19 and extends out of the bearing 7 at both sides. A means is provided to oscillate the sley shaft portion 13 and includes a pair of cams 9, 10 secured in each bearing 7 to the main shaft 8, cam 9 being operatively associated with a roller 11 of a cam follower 12 secured to the shaft portion 13 in the bearing 7 while cam 10 is operatively associated with a roller **11*a* of the cam follower 12*a* also secured to the shaft portion 13 in the bearing 7**.

A means for coupling the reed 4 to the sley shaft portions 13 includes a balance weight in the form of a shaft section 15 opposite the reed 4 relative to the axis 19 of oscillation. This means includes a means, such as a coupling member 14, at each end of the shaft section 15 which couples the shaft section 15 to a respective sley shaft portion 13 for oscillation with the sley shaft portions 13 and a means coupling the reed 4 directly to intermediate portions of the shaft section 15 for oscillation with the shaft section 15. This latter means includes the sley 3 and a plurality (e.g. three) of sley levers 16 which are secured to the shaft section 15. As shown, the shaft section 15 is located on an axis parallel to the axis 19 of the sley shaft portions 13 and is offset from these portions 13.

Referring to FIGS. 2 and 3, each sley lever 16 is secured to each shaft portion 15, by being clamped by a screw 17. Also, each lever 16 is hollowed so as to form a weight-reducing chamber 18 (FIG. 4).

Referring to FIGS. 2 and 3, each coupling member 14 is formed with two bores 21, 22 for receiving the respective sley shaft portion 13 and shaft section 15 and is secured to each via screws 26, 27, respectively.

As shown in FIG. 2, the sley 3 carries a shuttle guide formed of guide teeth 2 for a picking element, viz. a gripper shuttle; only one such tooth is visible in FIG. 2.

The shaft section 15 which acts as a balance weight is of corresponding weight to the removed portions of the sley shaft, i.e. the portions between the shaft portions 13. As such, the shaft section 15 serves to dispose the center of gravity 23 of the reed 4 and the means coupling the reed 4 to the sley shaft portions 13 (i.e. the coupling elements 14, shaft section 15, sley levers 16, sley 3 and where applicable, the shuttle guide 2 and cam followers 11, 11*a*, 12, 12*a*) coincident with the axis 19 of oscillation of the sley shaft. Thus, by having the unit composed of those parts oscillated in operation during beating-up by the sley shaft 13 in the direction indicated by a double arrow 24 oscillate about the sley shaft axis 19, a reduction in vibration is achieved.

As a comparison, FIG. 2 shows the center of gravity 25 obtained when a continuous sley shaft without parallel offset portions is used.

The weight of the unit composed of the coupling members 14, shaft sections 15, sley levers 16, sley 3, reed 4 and shuttle guide 2 which is moved by the sley shaft 13 or the cam followers 11, 11*a*, 12, 12*a* is about the same as the weight of a corresponding continuous sley shaft and of the associated unit parts thereof. Consequently, the moment of inertia of the unit 14, 15, 16, 3, 4, 2 relative to the axis 19 is approximately the same as for a sley drive having a continuous sley shaft.

In a variant, as shown in FIG. 7, the shaft portions 15 take the form of hollow section members (tubes) 15*a* as another weight-saving step. If required, the sley levers 16 can be made of light metal or a plastics.

Constructions are possible in which the center of gravity 23, instead of completely coinciding with the sley lever axis 19, is disposed close thereto in relation to the point 25.

What is claimed is:

1. A sley drive for a weaving machine comprising a sley shaft mounted for oscillation about a longitudinal axis, a reed, a balance weight, first means coupling said balance weight to said sley shaft for oscillation of said balance weight with said sley shaft about said longitudinal axis and, second means coupling said reed to said balance weight for oscillation therewith about said longitudinal axis whereby said shaft, reed, balance weight, first means and second means have a center of gravity coincident with said longitudinal axis.

2. A sley drive as set forth in claim 1 wherein said second means includes a sley mounting said reed thereon and a sley lever mounting said sley thereon and secured about said balance weight.

3. A sley drive as set forth in claim 1 wherein said first means includes a coupling securing said balance weight to said sley shaft.

4. A sley drive as set forth in claim 1 which further comprises a third means for oscillating said sley shaft, said third means including at least one cam follower secured to said sley shaft and wherein said shaft, reed, first means, balance weight, second means and cam follower have a center of gravity coincident with said longitudinal axis.

5. A sley drive as set forth in claim 4 which further comprises a shuttle guide mounted on said sley and wherein said shaft, reed, first means, balance weight, second means, cam follower and shuttle guide have a center of gravity coincident with said longitudinal axis.

6. A sley drive as set forth in claim 1 wherein said sley shaft is interrupted near said balance weight.

7. A sley drive as set forth in claim 1 wherein said sley lever is hollow.

8. A sley drive for a weaving machine comprising a sley shaft having at least two coaxial sley shaft portions, a plurality of bearings, each said bearing having a respective one of said sley shaft portions mounted for oscillation therein about a first longitudinal axis, a reed, at least one shaft section, each shaft section extending between a pair of said bearings on a second longitudinal axis parallel to said first longitudinal axis, first means at each end of said shaft section and coupling said shaft section to a respective one of said sley shaft portions for oscillation of said shaft section with said sley shaft portions about said first longitudinal axis, and second means coupling said reed to said shaft section for oscillation therewith about said first longitudinal axis whereby said shaft portions, reed, shaft section, first means and second means have a center of gravity coincident with said first longitudinal axis.

9. A sley drive as set forth in claim 8 wherein said first means includes a crank-web-like coupling member at each end of said shaft section coupling said shaft section to a respective sley shaft portion and said second means includes a plurality of sley levers coupling said reed to said shaft section.

10. A sley drive as set forth in claim 8 wherein said sley levers are clamped to said shaft section.

11. A sley drive as set forth in claim 8 wherein said shaft section is hollow.

12. A sley drive comprising a sley shaft mounted for oscillation about a longitudinal axis, a reed, and means coupling said reed to said shaft for oscillation therewith about said axis, said means including a balance weight opposite said reed relative to said axis whereby the center of gravity of said reed and said means is coincident with said axis.

13. A sley drive as set forth in claim 12 wherein said sley shaft is interrupted into at least two portions and said balance weight is a shaft section disposed in parallel between and offset from said sley shaft portions.

14. A sley drive as set forth in claim 13 wherein said means includes a coupling member secured at each end of said shaft section and coupled to a respective sley shaft portion, a plurality of sley levers secured to said shaft section, a sley secured to said sley levers and mounting said reed thereon.

15. A sley drive as set forth in claim 14 which further comprises a shuttle guide on said sley and second means for oscillating said sley shaft including at least one cam follower secured to each said sley shaft portion and wherein said coupling members, sley levers, sley, reed, shuttle guide, cam followers and shaft section have a center of gravity coincident with said axis.

* * * * *